US010829947B2

(12) United States Patent
Gallagher

(10) Patent No.: US 10,829,947 B2
(45) Date of Patent: Nov. 10, 2020

(54) DEVICE FOR MITIGATING DEBRIS TRAVEL AND METHOD

(71) Applicant: Blaine Gallagher, Butler, PA (US)

(72) Inventor: Blaine Gallagher, Butler, PA (US)

( * ) Notice: Subject to any disclaimer, the term of this patent is extended or adjusted under 35 U.S.C. 154(b) by 0 days.

(21) Appl. No.: 15/336,631

(22) Filed: Oct. 27, 2016

(65) Prior Publication Data

US 2018/0119438 A1 May 3, 2018

(51) Int. Cl.

| | |
|---|---|
| ***E04G 21/24*** | (2006.01) |
| ***E04G 21/30*** | (2006.01) |
| ***B08B 15/00*** | (2006.01) |
| ***B08B 15/02*** | (2006.01) |

(52) U.S. Cl.

CPC ..... *E04G 21/243* (2013.01); *B08B 15/02* (2013.01); *B08B 15/026* (2013.01); *E04G 21/30* (2013.01); *E04G 2021/248* (2013.01); *Y10S 52/12* (2013.01); *Y10S 135/90* (2013.01)

(58) Field of Classification Search

CPC . E04G 21/30; E04G 21/243; E04G 2021/248; B08B 15/02; B08B 15/026; Y10S 135/90

USPC ..... 135/900, 902; 52/39, DIG. 12; 160/369

See application file for complete search history.

(56) References Cited

U.S. PATENT DOCUMENTS

| | | | | |
|---|---|---|---|---|
| 4,214,317 A * | 7/1980 | Kelly, Sr. | A61F 9/02 175/211 |
| 4,682,448 A | 7/1987 | Healey | |
| 4,765,352 A | 7/1988 | Strieter | |
| 4,911,191 A | 3/1990 | Bain | |
| 5,024,246 A * | 6/1991 | Bain | B08B 15/026 134/200 |
| 5,062,871 A * | 11/1991 | Lemon, III | B08B 15/026 134/200 |
| RE33,810 E * | 2/1992 | Strieter | B08B 15/026 134/104.4 |
| 5,088,511 A * | 2/1992 | Bain | B08B 15/026 134/200 |
| 5,464,286 A | 11/1995 | Stevens et al. | |
| 6,149,252 A * | 11/2000 | Browning | B08B 15/026 134/200 |

(Continued)

FOREIGN PATENT DOCUMENTS

| | | | |
|---|---|---|---|
| FR | 3010430 A1 * | 3/2015 | |
| JP | 10245919 A * | 9/1998 | |
| JP | 2012184621 A * | 9/2012 | |

OTHER PUBLICATIONS 11 page Google translation of FR 3010430, May 2018.*

*Primary Examiner* — Robert Canfield

(74) *Attorney, Agent, or Firm* — Runyan Law; Charles Runyan

(57) ABSTRACT

A device for mitigating debris travel including a debris barrier, a support-frame, and a ceiling-attachment. The debris barrier includes a ceiling-opening-interface, a close-able-user-opening, an inside-surface, and an outside surface. The support-frame is fixed to the ceiling-opening-interface of the debris barrier. The support-frame is configured to hold open the ceiling-opening-interface, and further configured to hangingly support the debris barrier. The ceiling-attachment is fixed to the support-frame. The ceiling-attachment is configured to couple with a drop-ceiling, and the support-frame is shaped to seal against the support-frame.

11 Claims, 5 Drawing Sheets

(56) References Cited

U.S. PATENT DOCUMENTS

| | | | | |
|---|---|---|---|---|
| 6,383,242 | B1 * | 5/2002 | Rogers | B01D 46/42 454/63 |
| 6,840,254 | B1 * | 1/2005 | Windham | E04H 1/1244 135/117 |
| 7,134,444 | B2 * | 11/2006 | Mintie | B08B 15/00 135/131 |
| 7,188,636 | B1 * | 3/2007 | Kanne | B08B 15/02 135/142 |
| 8,137,156 | B1 * | 3/2012 | Gasman | B08B 15/026 451/28 |
| 2010/0058674 | A1 * | 3/2010 | Proctor | B08B 15/026 52/79.1 |
| 2012/0325279 | A1 | 12/2012 | Munoz | |
| 2013/0008620 | A1 * | 1/2013 | Cusick | E04G 21/30 160/372 |
| 2013/0058594 | A1 | 3/2013 | Shields | |
| 2017/0326026 | A1 * | 11/2017 | Kasbohm | A61H 33/066 |

* cited by examiner

DEVICE FOR MITIGATING DEBRIS TRAVEL AND METHOD

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

1. Field of the Invention

The present invention relates generally to the field of a tent, canopy, or umbrella and more specifically relates to a personal enclosure.

2. Description of Related Art

A dropped ceiling is a secondary ceiling surface which is typically hung below the inside surface of the main structural ceiling of a building. Modern dropped ceilings are intended to conceal the building infrastructure (e.g., piping, wiring, and/or ductwork, etc.). A concealed space is created above the dropped ceiling and below the building inside ceiling, while allowing access for repairs and/or inspections.

Drop ceilings may also be used to hide problems, such as water or structural damage to the building. Further, dropped ceilings can also conceal the sprinkler systems while still providing full fire suppression functionality. Commonly, a dropped ceiling consists of rectangular or square tiles with a framework to support the tiles. The framework is typically suspended from the interior ceiling surface of the building. Such framework may be metallic.

Often utility personnel or building maintenance technicians may need to access the utilities contained between the drop ceiling and the building ceiling to perform maintenance or improvements. Such tasks may expose or distribute debris and/or dusts created by the work related tasks. Also, drop ceilings may be included in office buildings, medical buildings or the like which may require a substantially clean environment, where dust and debris is undesirable.

U.S. Pat. No. 4,682,448 to Healey relates to a shelter. The described shelter device includes a shelter for interior use within a living space, an office space or working space, defining an enclosure extending from the floor to the ceiling and providing access through a ceiling opening for above-ceiling construction and/or repair while containing debris engendered as a consequence of such activities and/or falling objects. A suitable solution is needed such that work may be performed within a drop ceiling to minimize debris created during work within a drop ceiling into the space below.

BRIEF SUMMARY OF THE INVENTION

In view of the foregoing disadvantages inherent in the known worker or spectator shelter art, the present disclosure provides a novel device for mitigating debris. The general purpose of the present disclosure, which will be described subsequently in greater detail, is to provide a device for mitigating debris travel during work performed in a drop ceiling.

According to one embodiment, a device for mitigating debris travel is disclosed herein. The device for mitigating debris travel includes a debris barrier, a support-frame, and a ceiling-attachment. The debris barrier includes a ceiling-opening-interface, a closeable-user-opening, an inside-surface, and an outside surface. The ceiling-opening-interface is configured to receive and contain debris into the inside-surface. The closeable-user-opening is configured to enclose at least a portion of a user, and further configured to limit debris travel out of the inside-surface. The support-frame is fixed to the ceiling-opening-interface of the debris barrier. The support-frame is configured to hold open the ceiling-opening-interface, and further configured to hangingly support the debris barrier. The ceiling-attachment is fixed to the support-frame; the ceiling-attachment is configured to removably couple with at least a portion of the ceiling and to support the upper-frame and the debris barrier when coupled to the portion of the ceiling.

According to another embodiment, a method of using a device for mitigating debris travel is also disclosed herein. The method of use includes a providing a device for mitigating debris travel, removing a ceiling tile within a building, expanding the device for mitigating debris travel, placing the device for mitigating debris travel within a drop-ceiling of the ceiling within the void created by the removal of the ceiling tile, opening a closeable-user-opening of the device for mitigating debris travel, entering the closeable-user-opening of the device for mitigating debris travel, closing the closeable-user-opening of the device for mitigating debris travel, performing a work-related task within the device for mitigating debris travel.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a device for mitigating debris travel, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to a personal enclosure and more particularly to a device for mitigating debris travel and method as used to improve the mitigation of debris travel into a building during work performed within a drop ceiling.

Generally, a device for mitigating debris travel is affixable around the waist of a user and attached to a ceiling grid (e.g., with magnets) corresponding. The corresponding ceiling tile may be removed without the hole created by the removed ceiling tile being exposed. Applications include the clearing of mold and other hazards out of ceilings in hospitals or similar buildings. Users may wear or use additional personal safety equipment such as helmets, goggles, air filters, headlamps, etc.

The device is intended to be a personal system that is more easily portable and personal than is currently available. The device may include a plastic, vinyl, or similar sheeting material (but not limited thereto). For example, the material may be visualized like a garbage bag that attaches to a user's waist and then goes up to the ceiling to enclose the work area. The device is attachable to the ceiling grid, which may include the use of magnets. Such an arrangement protects the surroundings from possible exposure from debris.

Referring now more specifically to the drawings by numerals of reference, there is shown in FIGS. 1-4, various views of a device for mitigating debris travel 100.

Figure 1:
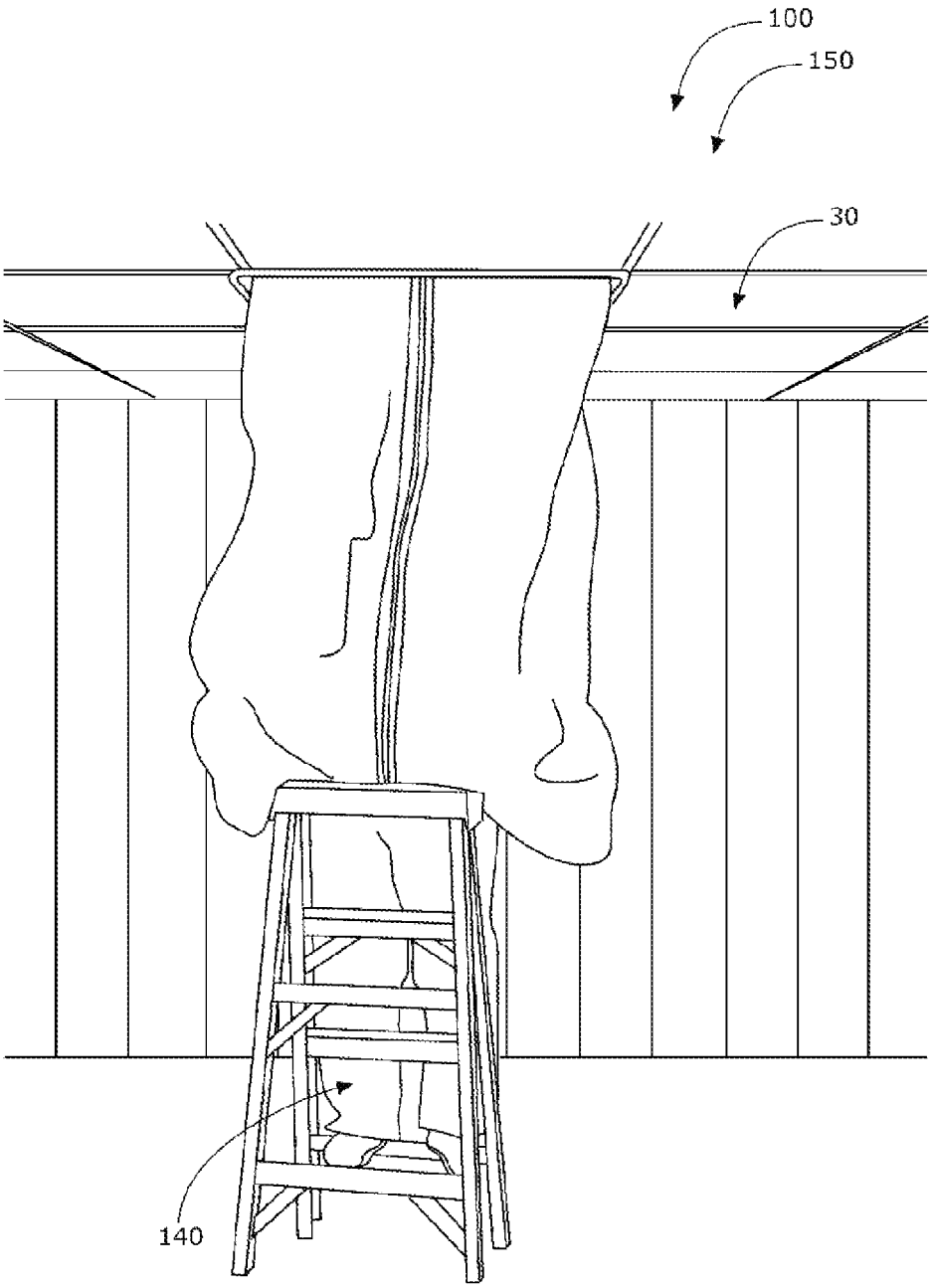
FIG. 1 is a front view of the device for mitigating debris travel, during an 'in-use' condition, according to an embodiment of the present disclosure.

FIG. 1 shows a device for mitigating debris travel 100 during an 'in-use' condition 150, according to an embodiment of the present disclosure. Here, the device for mitigating debris travel 100 may be beneficial for use by a user 140 to limit the debris travel outside of the device 100 by re-closing or re-sealing a work area above a drop-ceiling 30 after removal of a ceiling panel. As illustrated, the device for mitigating debris travel 100 may include a debris barrier 110, a support-frame 120, and a ceiling-attachment 130. As illustrated, the debris barrier 110 may attach to the user 140 (e.g., cinched up to a waist of the user 140), or otherwise be configured such that debris is limited from passing beyond the user 140.

In embodiments, debris barrier 110 may be constructed from a lightweight, impermeable material such as plastic, nylon, etc. Similarly the debris barrier 110 may be constructed from a woven-textile material. Other materials may be used for construction of debris barrier 110, depending upon user preferences and specific applications. For example, disposable or reusable materials may be used. The debris barrier 110 may be waterproof, may be impermeable to particulate matter, and may be mildew resistant. Some embodiments of debris barrier 110 may include a debris barrier 110 that is at least semi-transparent. Alternate embodiments may include debris barrier 110 which may be opaque.

Figure 2:
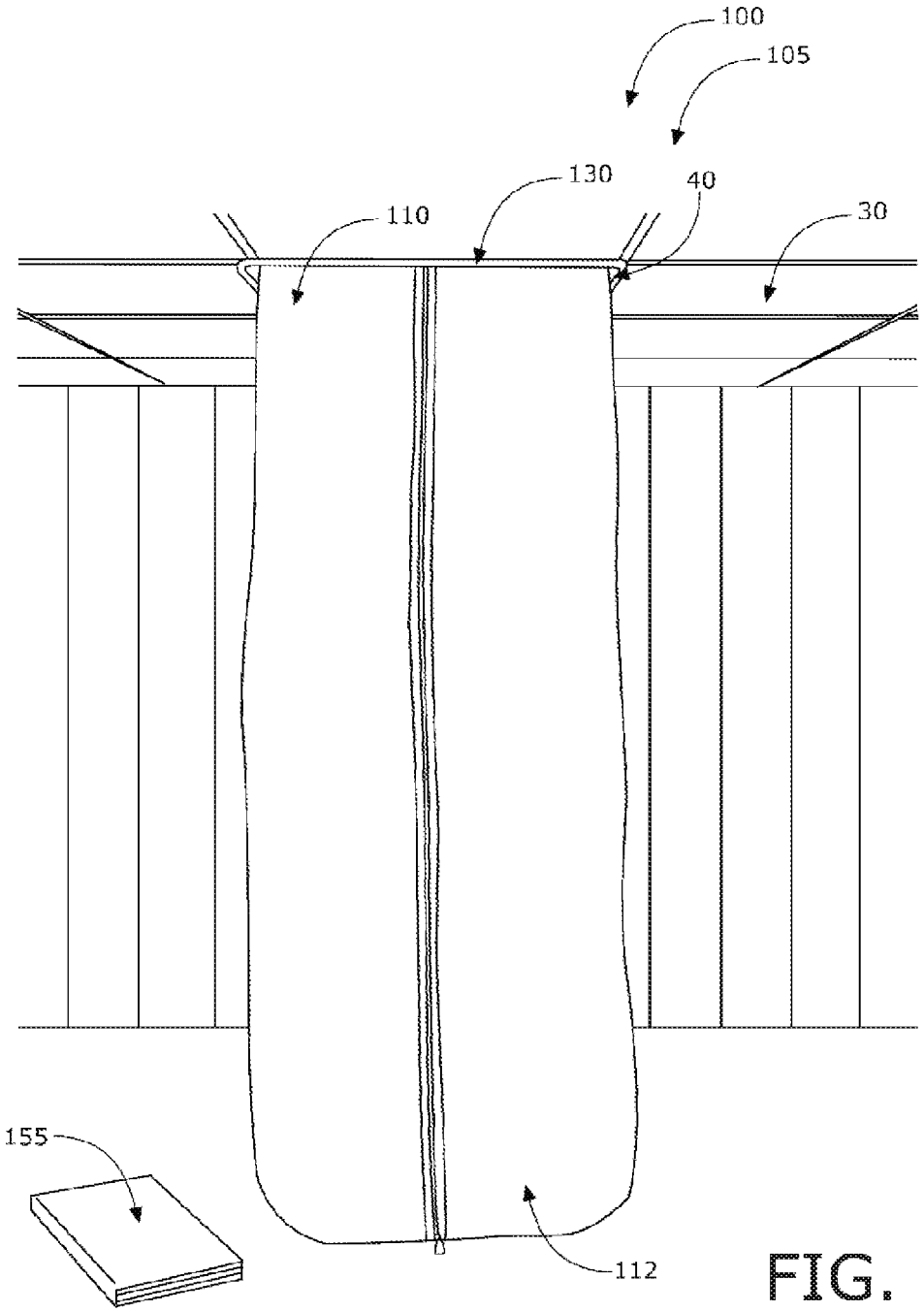
FIG. 2 is a front view of the device for mitigating debris travel of FIG. 1, according to another embodiment of the present disclosure.

FIG. 2 shows the device for mitigating debris travel 100 according to another embodiment of the present disclosure. As shown and discussed above, the device for mitigating debris travel 100 may include the debris barrier 110, the support-frame 120 (FIG. 3), and the ceiling-attachment 130. However, as illustrated here, the debris barrier 110 may be independently closable such that debris travel is blocked, independently of whether the user 140 (FIG. 1) is present. In particular, the device for mitigating debris travel 100 may have sufficient length to extend from the drop-ceiling 30, touching and/or at least partially resting on a floor.

Embodiments of support-frame 120 may be shaped to match a predefined opening of drop-ceiling 30. In particular, the predefined opening of drop-ceiling 30 may include panel opening 40 (e.g., and opening created once an individual panel is removed from a panel support frame of the drop-ceiling 30), and the support-frame 120 may be shaped to seal against the panel support frame. For example, where the individual panel is rectangular, the support-frame 120 may be rectangular too. Likewise, where the individual panel is square, the support-frame 120 may be square. According to one embodiment, the ceiling-attachment 130 may be configured to magnetically couple with drop-ceiling 30.

The device for mitigating debris travel 100 may further include a closeable-user-opening 112 configured to provide ingress and egress from the otherwise closed debris barrier 110. The closeable-user-opening 112 may be limited to a size corresponding to the user 140. Alternately, and as shown, the closeable-user-opening 112 may extend along the majority or all of the vertical length of the debris barrier 110.

According to one embodiment, the closeable-user-opening 112 may include a toolless fastener, such as a zipper 136. Further, the closeable-user-opening 112 may be completely closable via the zipper 136 such that debris travel out of an inside-surface 113 (FIG. 3) of the debris barrier 110 through the closeable-user-opening 112 is prevented or otherwise limited, in some embodiments. Other embodiments may have the closeable-user-opening 112 including a plurality of buttons, and similarly, the closeable-user-opening 112 may be completely closable via the plurality of buttons. Alternately, the closeable-user-opening 112 may be closeable via hook-and-loop a fastener system. Other embodiments of closeable-user-opening 112 may include magnetic fastening. Other toolless fasteners and combinations thereof are contemplated.

According to one embodiment, the device for mitigating debris travel 100 may be arranged as a kit 105. In particular, the device for mitigating debris travel 100 may further include a set of instructions 155. The instructions 155 may detail functional relationships in relation to the structure of the device for mitigating debris travel 100 (such that the device for mitigating debris travel 100 can be used, maintained, or the like, in a preferred manner).

Figure 3:
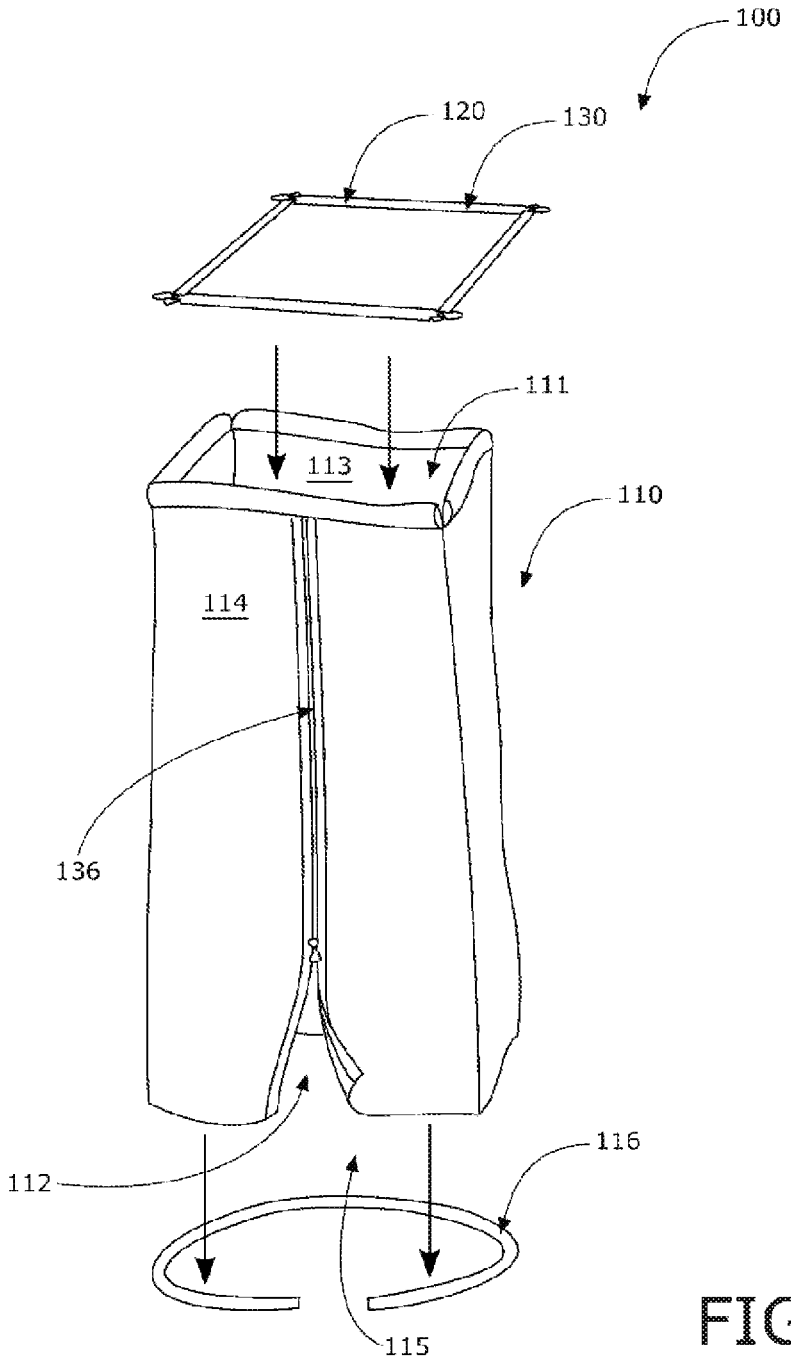
FIG. 3 is an exploded view of the device for mitigating debris travel of FIG. 3, according to an embodiment of the present disclosure.

FIG. 3 is an exploded view of device for mitigating debris travel 100 of FIG. 1, according to an embodiment of the present disclosure. As above, the device for mitigating debris travel 100 may include the debris barrier 110, the support-frame 120, and the ceiling-attachment 130. The debris barrier 110, including the closeable-user-opening 112, may be configured to have a ceiling-opening-interface 111, an inside-surface 113, and an outside surface 114. Further, the closeable-user-opening 112 may include a bottom-opening 115.

The support-frame 120 may be fixed to ceiling-opening-interface 111 of debris barrier 110, with the support-frame 120 configured to hold open ceiling-opening-interface, 111 and further configured to hangingly support debris barrier 110. For example, and as shown, the support-frame 120 may slide within a sleeve (or series of sleeves) fixed to the ceiling-opening-interface, 111.

In addition, as above, the ceiling-attachment 130 may be configured to magnetically couple with the drop-ceiling 30 (FIG. 2), at the panel opening 40 (FIG. 2), and the support-frame 120 may be shaped to seal against the panel opening 40. As illustrated, the ceiling-attachment 130 may include one or more magnetic strips adhered to a top side or otherwise integrated with the support-frame 120.

According to one embodiment, the bottom-opening 115 of the debris barrier 110 may include an elastic-band 116 that is closable about the user 140. In particular, the elastic-band 116 may be configured to contract around one or more portions of the user 140 (e.g., a waist). As such, the bottom-opening 115 may be closable about user via the elastic-band 116 such that debris travel out of inside-surface 113 through bottom-opening 115 is prevented or otherwise limited.

Figure 4:
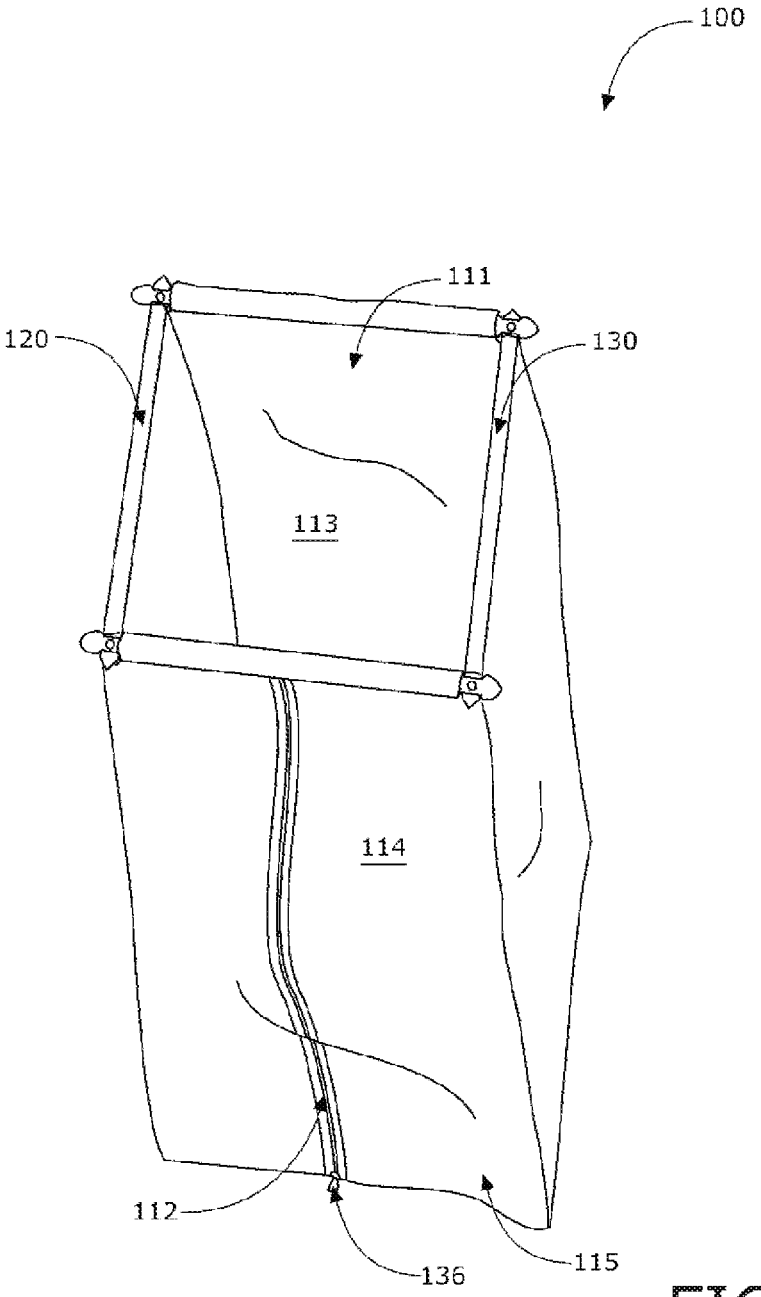
FIG. 4 is a top perspective view of the device for mitigating debris travel of FIG. 1, according to an embodiment of the present disclosure.

FIG. 4 is a top perspective view of device for mitigating debris travel 100 of the of FIG. 1, according to an embodiment of the present disclosure. As above, the debris barrier 110 may include the ceiling-opening-interface 111, the closeable-user-opening 112, the inside-surface 113, and the outside surface 114. The ceiling-opening-interface 111 may be configured to receive debris into inside-surface 113, and closeable-user-opening 112 may be configured to enclose at least a portion of user 140 (FIG. 1), and further configured to limit debris travel out of inside-surface 113. The ceiling-attachment 130 may be fixed to support-frame 120. The ceiling-attachment 130 may be configured to removably couple with at least a portion of the ceiling and to the support-frame 120 and the debris barrier 111 when coupled to the portion of the ceiling.

Figure 5:
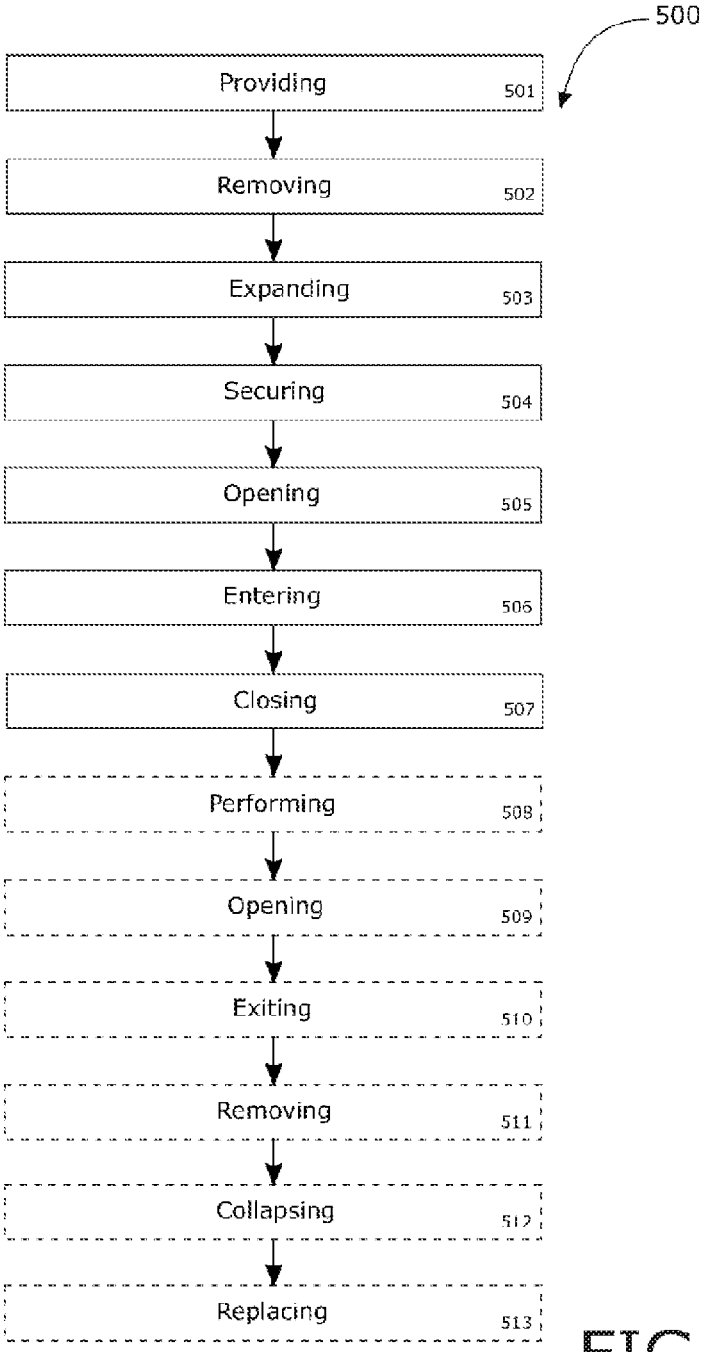
FIG. 5 is a flow diagram illustrating a method of use for mitigating debris travel via the device shown in FIGS. 1-4, according to an embodiment of the present disclosure.

FIG. 5 is a flow diagram illustrating a method for mitigating the debris travel during work performed within a ceiling, according to an embodiment of the present disclosure. In particular, the method for mitigating the debris travel during work performed within a ceiling 500 may include one or more components or features of the device for mitigating debris travel 100 as described above.

As illustrated, the method for mitigating the debris travel during work performed within a ceiling 500 may include the steps of: step one 501, providing device for mitigating debris travel 100; step two 502, removing a ceiling tile within a building; step three 503, expanding device for mitigating debris travel; step four 504, securing the device for mitigating debris travel to the opening in the drop-ceiling of the ceiling, the opening corresponding to a removed the ceiling tile; step five 505, opening a closeable-user-opening of the drop-ceiling; step six 506, entering the closeable-user-opening of device for mitigating debris travel; step seven 507, closing the closeable-user-opening of the device for mitigating debris travel; and step eight 508, performing a work-related task within the device for mitigating debris travel.

The method for mitigating the debris travel during work performed within a ceiling 500 may further include step nine 509, opening the closeable-user-opening of device for mitigating debris travel 100; step ten 510, exiting device for mitigating debris travel via closeable-user-opening; step eleven 511, removing device for mitigating debris travel from the ceiling of the building; step twelve 512, collapsing device for mitigating debris travel; and step thirteen 513, replacing the ceiling tile within the ceiling of the building.

It should be noted that step nine 509, step ten 510, step eleven 511, and step twelve 512 are optional steps and may not be implemented in all cases. Optional steps of method of use 500 are illustrated using dotted lines in FIG. 5 so as to distinguish them from the other steps of method of use 500. It should also be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for mitigating the debris travel during work performed within a ceiling (e.g., different step orders within above-mentioned list, elimination or addition of certain steps, including or excluding certain maintenance steps, etc.), are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A device for mitigating debris travel through an opening in a drop-ceiling, the device comprising:

a debris barrier having an inside-surface and an outside surface, and including a ceiling-opening-interface and a closeable-user-opening, said ceiling-opening-interface configured to receive debris into the inside-surface from the opening in the drop-ceiling, said closeable-user-opening includes a substantially vertical opening and a bottom-opening, the bottom-opening including an elastic band, said bottom-opening configured to close about the user via the elastic band;

a support-frame fixed to the ceiling-opening-interface of the debris barrier, the support-frame configured to hold open the ceiling-opening-interface, and further configured to support the debris barrier;

and wherein the opening of the drop-ceiling is a panel opening, and the support-frame is shaped to seal against a panel support-frame;

wherein the substantially vertical opening is completely closable via a zipper such that debris remains within the debris barrier;

and a ceiling-attachment fixed to the support-frame, said ceiling-attachment configured to removably couple with at least a portion of the drop-ceiling and to support the support-frame and the debris barrier when coupled to the portion of the drop-ceiling.

2. The device of claim 1, wherein the debris barrier is constructed from a plastic material.

3. The device of claim 1, wherein the debris barrier is constructed from a woven-textile material.

4. The device of claim 1, wherein the debris barrier is waterproof.

5. The device of claim 1, wherein the debris barrier is impermeable to particulate matter.

6. The device of claim 1, wherein the debris barrier is mildew resistant.

7. The device of claim 1, wherein the debris barrier is at least semi-transparent.

8. The device of claim 1, wherein the debris barrier is opaque.

9. The device of claim 1, wherein the ceiling attachment is further configured to magnetically couple with the drop-ceiling.

10. A method comprising the steps of:

providing a device for mitigating debris travel through an opening in a drop-ceiling comprising:

a debris barrier having an inside-surface and an outside surface, and including a ceiling-opening-interface and a closeable-user-opening, said ceiling-opening-interface configured to receive debris into the inside-surface from the opening in the drop-ceiling, said closeable-user-opening includes a substantially vertical opening and a bottom-opening, the bottom-opening including an elastic band, said bottom-opening configured to close about the user via the elastic band;

a support-frame fixed to the ceiling-opening-interface of the debris barrier, the support-frame configured to hold open the ceiling-opening-interface, and further configured to support the debris barrier;

and wherein the opening of the drop-ceiling is a panel opening, and the support-frame is shaped to seal against a panel support-frame;

wherein the substantially vertical opening is completely closable via a zipper such that debris remains within the debris barrier;

and a ceiling-attachment fixed to the support-frame, said ceiling-attachment configured to removably couple with at least a portion of the drop-ceiling and to support the support-frame and the debris barrier when coupled to the portion of the drop-ceiling;

removing a ceiling tile from the drop-ceiling;

expanding the device for mitigating debris travel;

securing the device for mitigating debris travel to the opening in the drop-ceiling of the ceiling, the opening corresponding to a removed the ceiling tile;

opening a closeable-user-opening of the device for mitigating debris travel;

entering the closeable-user-opening of the device for mitigating debris travel;

closing the closeable-user-opening of the device for mitigating debris travel;

and performing a work-related task within the device for mitigating debris travel.

11. The method of claim 10, further comprising the steps of:

opening the closeable-user-opening of the device for mitigating debris travel;

exiting the device for mitigating debris travel via the closeable-user-opening;

removing the device for mitigating debris travel from the drop-ceiling;

collapsing the device for mitigating debris travel;

and replacing the ceiling tile to the drop-ceiling.

* * * * *